United States Patent [19]

Dorn

[11] Patent Number: 4,944,694

[45] Date of Patent: Jul. 31, 1990

[54] ELECTRIC CORD TAKE-UP DEVICE

[76] Inventor: Kevin L. Dorn, 4816 South 29th St., Arlington, Va. 22206

[21] Appl. No.: 329,820

[22] Filed: Mar. 28, 1989

[51] Int. Cl.[5] ..... H01R 13/72

[52] U.S. Cl. ..... 439/501; 439/528

[58] Field of Search ..... 191/12 R, 12.4; 439/456, 457, 501, 528

[56] References Cited

U.S. PATENT DOCUMENTS

| | | | |
|---|---|---|---|
| 2,666,841 | 1/1954 | Laver . | |
| 2,763,707 | 9/1956 | Soderberg . | |
| 3,049,688 | 8/1962 | Sinopoli . | |
| 3,089,210 | 5/1963 | Ritter | 191/12 R X |
| 3,221,287 | 11/1965 | Rooney . | |
| 3,290,453 | 12/1966 | Jensen . | |
| 4,083,621 | 4/1978 | Davidson et al. . | |
| 4,095,871 | 6/1978 | Holte . | |
| 4,210,380 | 7/1980 | Brzoster | 439/456 |
| 4,220,391 | 9/1980 | Krolak et al. . | |
| 4,500,150 | 2/1985 | Leibensperger et al. . | |
| 4,705,484 | 11/1987 | Lerner et al. . | |

FOREIGN PATENT DOCUMENTS

| | | | |
|---|---|---|---|
| 2620432 | 11/1977 | Fed. Rep. of Germany | 439/528 |

*Primary Examiner*—Eugene F. Desmond

*Attorney, Agent, or Firm*—Foley, Lardner, Schwartz, Jeffery, Schwaab, Mack, Blumenthal & Evans

[57] ABSTRACT

An electric wire take up device or container is which the wires each enter the container through a series of cut-outs in one of its sides. Upstanding pegs on the base of the container serve as wire wrapping posts for each wire. With a sufficient number of pegs, numerous wrapping patterns are available to the user of the device. Upon completing the wrapping of a wire, the male plug at the end of the wire can be inserted into the power outlet strip also located within the container.

13 Claims, 3 Drawing Sheets

ELECTRIC CORD TAKE-UP DEVICE

BACKGROUND OF THE INVENTION

The universal popularity and use of electrical and electronic devices in homes and offices today create a proliferation and tangle of wires needed to operate these devices. In many homes and offices, wires are strewn along floors, behind furniture and under rugs.

These wires are especially unsightly, tangled and dangerous when longer than needed to reach from a wall outlet to the device or appliance they energize. Also, it is hard to associate an individual wire with its appliance when the wires are tangled. Housecleaning becomes harder and the danger of tripping or stumbling over a wire is greater.

Outdoor wires cause many of the same problems. Also, TV and radio reception can be improved if wires are arranged in an orderly manner so that power cables are separated from signal and antenna wires. Inevitable kinks and knots add to the entanglement of these wires. If the wires are connected to cooking equipment, tripping over one of them may cause a dangerous spill.

Many solutions and devices have been developed for "taking up" excess lengths of wires, but none combine practicality, effectiveness and aesthetics. Most of these devices accommodate only one wire, so that numerous devices are needed for taking up or reeling in a plurality of wires. U.S. Pat. No. 4,083,621 shows such a single wire take-up device. Other devices, such as U.S. Pat. No. 3,290,453, rely on spring loaded take-up mechanisms, but these lose their effectiveness as the spring loses its resiliency.

SUMMARY OF THE INVENTION

The present invention is an attractively configured container for taking up an excess length of electrical cord or wire connected to an appliance or device. It is not practical, nor is it always safe, to cut and splice wires to the correct length. Wire splicing, therefore, is completely eliminated in the invention. The invention, instead, enables the user of the appliance to wrap any excess wire about pegs or posts upstanding in a covered container or box.

The container is which the excess wire is taken up has a size and configuration that make it aesthetically compatible with other electrical components. It could, for example, be about the rectangular shape and volume of a Hi-Fi amplifier, and could, thereby, be placed on a shelf with such equipment. It could also be placed on the floor or on a counter to supply power to one or more lamps or kitchen appliances. It is portable, and may be used in different locations and for different purposes at different times. The user could even hang the invention on a wall or on the back of an electrical component cabinet, as well as use it in any orientation.

An object of the invention, therefore, is to provide a wind-up device for excessive lengths of electrical cord, that is simple to use, inexpensive and attractive.

Another object of the invention is to provide an electrical cord take-up device that can supply electricity to a plurality of appliances or devices.

A further object of the invention is to provide an openable and closable container in which excess lengths of cord can be wound around pegs to be taken up.

A still further object of the invention is to provide a compact and attractive wire or cord management apparatus that safely shortens the effective lengths of one or more cords.

Other objects of the invention will become apparent upon reading the specification and examining the related drawings.

BRIEF DESCRIPTION OF THE DRAWINGS

FIG. 4(*b*) is an alternate securing means, formed by splitting lengthwise the pin as illustrated in FIG. 3.

DETAILED DESCRIPTION OF THE PREFERRED EMBODIMENTS

Figure 1:
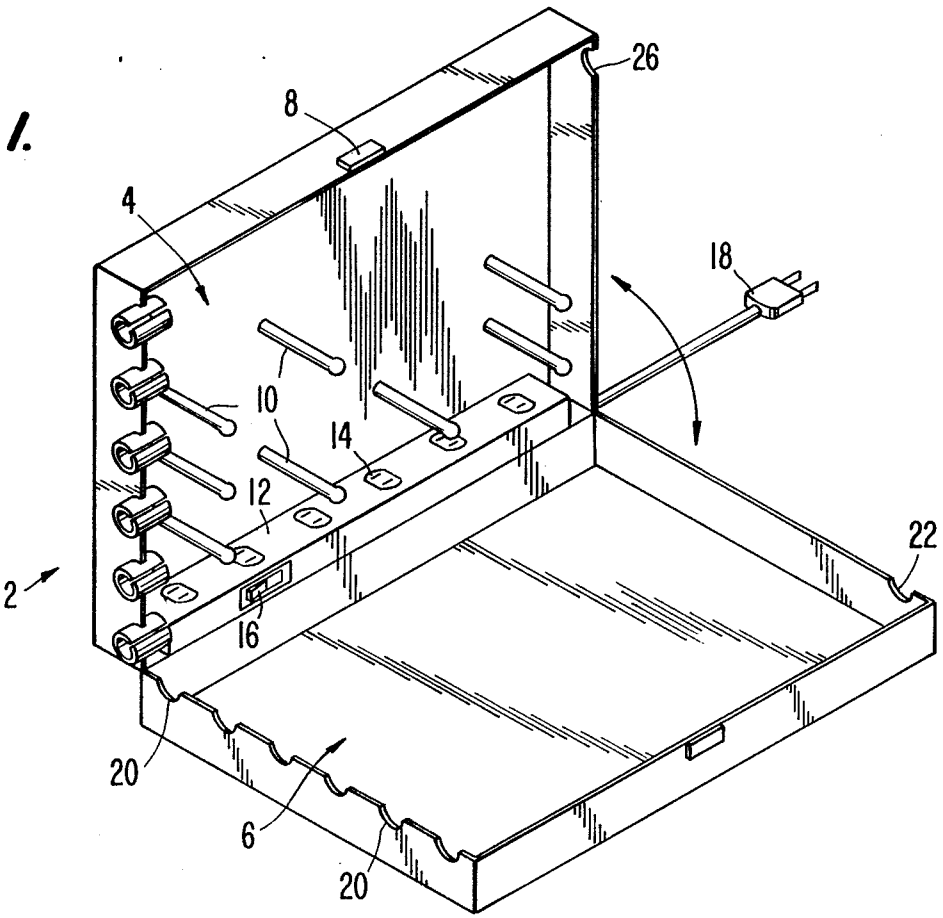
FIG. 1 is a perspective view of the invention, showing the interior of the wire or cord container, the pegs about which the wires are wrapped and other features.

Referring to FIG. 1, the container 2 is formed in a generally rectangular shape, with a bottom or base 4 and a top or cover 6. Other shapes may be used, however. As indicated by the arrow, the container is intended to be opened and closed. While a latch 8 is illustrated, the container may be held securely closed either by latching or by the friction fitting of its top and bottom. A hinge or hinges for opening and closing the container are not shown.

The container may be made of any material having electrical insulating properties, e.g., wood or a commercially available rigid plastic. In practice, however, rigid plastic has proven to be less expensive to manufacture, lighter in weight and equally insulative. The material selected should nevertheless be amenable to ornamentation or decoration, since it may be visibly used in homes.

The dimensions of the container would be varied for adaptation to a particular use. As will be explained, the embodiment of FIG. 1 is intended to accommodate the wiring for a maximum of six appliances or other electrical devices. The container would be made larger or smaller depending on whether more or fewer electrical wires are to be accommodated.

The bottom of the container contains a plurality of perpendicularly upstanding pegs 10. The particular pattern and number of pegs again depend on the use to which the invention is to be put. The arrangements of pegs are discussed in connection with FIG. 2. As far as FIG. 1 is concerned, however, the pegs are securely fastened in the base. Each peg will be subjected to the wrapping force of an electrical wire, and must be secure enough to avoid being sheared or pulled loose from the base.

An electrical outlet strip 12 is provided at one end of the base, although its location inside or even outside of the container could vary. After appropriately wrapping the cords or wires about the pegs to remove any excess slack or length, the male plug ends of each cord is then inserted into an outlet in electric plug strip 12. A plurality of female outlets 14 are provided along the strip 12 for this purpose.

Figure 2:
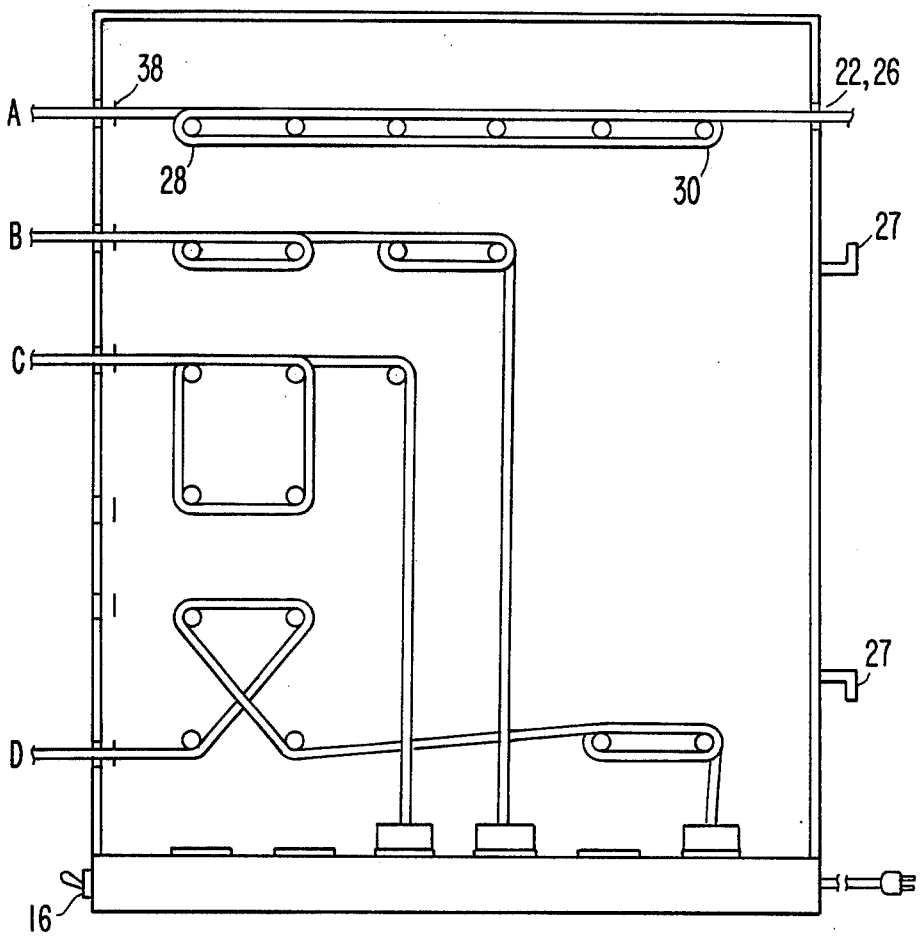
FIG. 2 is a top plan view of the container base, showing the wire wrapping pegs and electric cords wrapped therearound in various illustrative patterns.

An on-off switch 16 is connected to the plug strip 12. This on-off switch is located within the container, i.e., the container must be open for the switch to be used. The on-off switch could be located outside of the closed container, however, as shown in FIG. 2, to allow its operation even when the container is closed. A plurality of on-off switches could also be provided to enable the selective energization of appliances. The socket strip is energized by means of male plug 18. The outlet strip could also incorporate a fuse or circuit breaker to protect the electrical appliances from power surges.

Figure 4A:
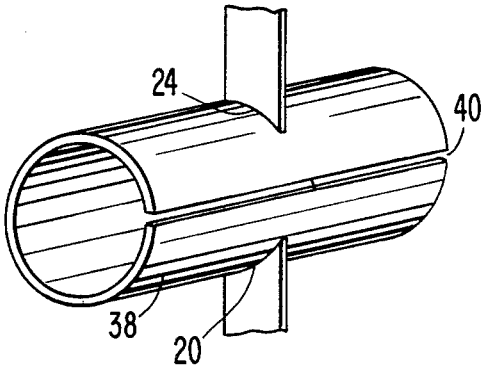
FIG. 4(*a*) shows a sleeve for securing an electric cord at its point of entry into the container.

The cover 6 contains semi-circular cut-outs 20 along at least one of its sides. The other side of the cover also may contain one or more of such cutouts 22. The cut outs 20 and 22 register with cut-outs 24 in the base of the container, as illustrated in FIG. 4. When the container is closed, each registering pair of cut-outs forms a circular opening into the interior of the container. The registering openings 22 and 26 form another opening on the opposite side of the container.

Wires are introduced into the interior of the container through these circular cut-outs. The embodiment of FIG. 1 contains six cut-outs, thereby accommodating the introduction into the container of six electric cords or wires. If needed, however, one cut-out could even accommodate more than one wire. The rows of pegs are aligned, as viewed in FIG. 1, with the respective cutouts. The number and/or placement of pegs in each row can vary, however, in accordance with the wishes of the user and to provide as many different wire wrapping patterns as would be desired.

FIG. 2 illustrates various wire wrapping patterns. It is immediately obvious, however, that these illustrated patterns are only exemplary. A far greater number of patterns is available, and, with the possibility of adding pegs and moving them to different locations on the base, an almost infinite number of wrapping patterns is available. Four such patterns, (A, B, C and D) are illustrated in FIG. 2.

Pattern A shows the wire wrapped about pegs 28 and 30, to take up a considerable amount of wire slack. The height of each peg can be made so that more than one wire can be wrapped about it, although such a pattern has not been illustrated. Pattern A also illustrates that possibility of using the container simply to take up slack in a wire without making an electrical connection at one end of the wire. In this regard, note that the wire extends through the side of the container opposite the side through which it entered. The wire exits through the cut-out formed by the registration of semi-circular cut-outs 22 and 26.

Pattern B shows a typical pattern for removing from the wire a smaller amount of slack than is removed by pattern A. In pattern B, the wire is energized by plugging its end into a convenient outlet in the outlet strip.

Patterns C and D show the use of multiple rows of pegs to take up slack in a wire. These patterns can be employed to avoid 180° bends or turns in a wire, if the stiffness of the wire makes this necessary or desirable. Of course, a particular pattern can utilize even more than two rows, to further minimize the wire bending angle.

Figure 3:
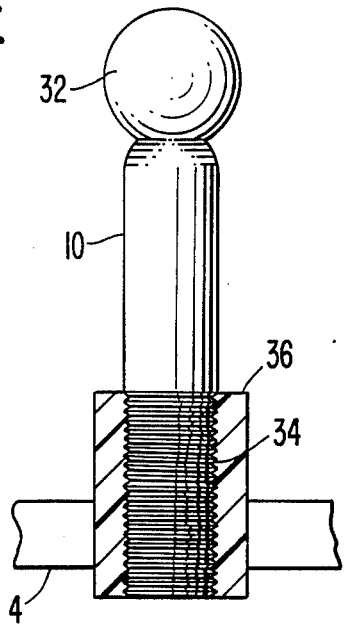
FIG. 3 shows a pin fixedly attached to the base of the container.

FIG. 3 shows a peg suitable for use in the container. Each peg is formed with a notched portion and a bulbous head to prevent wires from slipping over its top. The number of wires that may be wrapped around each peg, as mentioned earlier, is determined by the height of the peg. The height of the peg, in turn, is limited by the thickness of the closed container. A pair of external pegs 27 may also be provided, around which excess lengths of the power cord may be wrapped.

In the embodiment of FIG. 3, the end 34 of each peg is threaded to match the threaded inserts 36 in the base 4 of the container. This threading arrangement provides rigidity of the pegs as wires are wound around them and pulled tight. The base may contain a large number of these threaded inserts 34, or holes in which the threaded inserts can be placed, so that a user can place the pegs in the base where he wishes.

Another embodiment of the invention utilizes a predetermined peg arrangement, in which the locations of the pegs are determined at the time of manufacture. If the base is molded from rigid plastic, for example, the pegs could be molded as part of the base.

Each cut-out may be fitted with a plastic sleeve 38, such as that shown in FIG. 4(*a*). These sleeves hold each wire in position in the cut-out in which it is placed, while the other wires are being wound. If the wires are fairly stiff, it can be difficult without the sleeves to keep six or so of them in position at the same time within their respective cut-outs in order to close the container.

The sleeves can be made of resilient plastic, and each contains a slit 40 along its length. On account of the slit, the sleeve may be opened and a wire inserted therein. The sleeve then closes to hold the wire. The gripping sleeves 38 are schematically illustrated in FIG. 2. Such sleeves are not necessary to the operation of the invention, however, especially when thin wires are being wrapped.

Figure 4B:
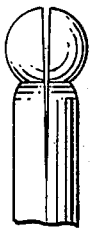

Other wire gripping elements may be used in lieu of sleeves. FIG. 4(b) shows a longitudinally split wrapping pin having a split upper end. The resiliency of the plastic causes it to clasp a wire placed therebetween.

When the container is closed, it may be placed in proximity to other Hi-Fi components. Practically no heat is produced by the invention in use. If used outdoors, it is desirable, however, to weather proof the container. Otherwise securing means can, obviously, be used. These can include a resilient plastic post, as illustrated at FIG. 4, split at its center to capture an electric cod therein.

It will be obvious to those skilled in the art that various changes may be made in the invention without departing from its spirit and scope. Accordingly, the invention is not limited by the illustrations and description in the specification.

What is claimed is:

1. An electric wire take up device, comprising:

a closable container having a top and a bottom;

pegs fixed to the bottom of the container, the pegs being arranged in predetermined geometric patterns;

cut-outs in at least one side of the container; and an electrical outlet strip in the container, the outlet having a plurality of plugs; and wire securing means associated with each cutout;

wherein an electric wire introduced into the container through one of the cut-outs can be wrapped about one or more pegs in a unique pattern and its end plugged into the outlet.

2. the take up device of claim 1, in which the number of pegs forming the geometric pattern can be varied.

3. The take up device of claim 1, in which the pegs are detachable from the base, and the orientation of the pegs within the container may be selected by the user of the device.

4. The take up device of claim 1, in which the wire securing means are longitudinally split plastic sleeves.

5. The take up device of claim 1, in which the top and bottom of the container are made of a rigid plastic.

6. The take up device of claim 1, in which the top and bottom of the container are hinged at one end of each for opening and closing.

7. The take up device of claim 1, in which the top and bottom of the container frictionally fit together for closure.

8. The take up device of claim 1, in which the outlet strip is controlled by a switch located in the closed container.

9. The take up device of claim 1, wherein the outlet strip is controlled by a switch located outside of the closed container.

10. The take up device of claim 1, wherein the pegs are integrally formed with the base.

11. The take up device of claim 1, further including a plurality of cut-outs, a wire being inserted through each or some of the cut outs into the interior of the container.

12. The take up device of claim further including at least one additional cut-out on the side of the container opposite the side on which the other cut-outs are located, the additional cut-out enabling a wire to exit from the container without its end being plugged into the outlet strip.

13. The take up device of claim 1, wherein the cut-outs are formed of aligned semi-circular cut-outs in the top and bottom of the container.

* * * * *